US006194832B1

(12) United States Patent
Juengst

(10) Patent No.: US 6,194,832 B1
(45) Date of Patent: Feb. 27, 2001

(54) METAL HALIDE LAMP WITH ALUMINUM GRADATED STACKED PLUGS

(75) Inventor: Stefan Juengst, Zorneding (DE)

(73) Assignee: Patent-Treuhand-Gesellschaft f. Elektrische Gluehlampen mbH, Munich (DE)

( * ) Notice: Subject to any disclaimer, the term of this patent is extended or adjusted under 35 U.S.C. 154(b) by 0 days.

(21) Appl. No.: 09/103,364

(22) Filed: Jun. 23, 1998

(30) Foreign Application Priority Data

Jun. 27, 1997 (DE) ..... 197 27 428

(51) Int. Cl.[7] ..... H01J 17/18; H01J 61/36

(52) U.S. Cl. ..... 313/625; 313/623; 313/624; 313/626

(58) Field of Search ..... 313/567, 622, 313/623, 624, 625, 626, 634, 636, 572, 573; 220/21 R

(56) References Cited

U.S. PATENT DOCUMENTS

| | | | | |
|---|---|---|---|---|
| 3,148,981 | | 9/1964 | Ryshkewitch . | |
| 4,155,758 | * | 5/1979 | Evans et al. | 75/232 |
| 4,400,647 | | 8/1983 | Palty . | |
| 4,404,492 | | 9/1983 | Palty . | |
| 4,602,956 | | 7/1986 | Partlow et al. . | |
| 4,780,646 | * | 10/1988 | Lange | 313/623 |
| 4,881,009 | * | 11/1989 | Passmore | 313/631 |
| 5,404,078 | | 4/1995 | Bunk et al. . | |
| 5,424,609 | | 6/1995 | Geven et al. . | |
| 5,484,315 | | 1/1996 | Juengst et al. . | |
| 5,592,049 | | 1/1997 | Heider et al. . | |
| 5,637,960 | | 6/1997 | Juengst et al. . | |
| 5,742,123 | * | 4/1998 | Nagayama | 313/623 |
| 5,861,714 | * | 1/1999 | Wei et al. | 313/625 |

FOREIGN PATENT DOCUMENTS 0 650 184 A1 4/1995 (EP) .

* cited by examiner

*Primary Examiner*—Nimeshkumar D. Patel
*Assistant Examiner*—Matthew J. Gerike
(74) *Attorney, Agent, or Firm*—Frishauf, Holtz, Goodman, Langer & Chick, P.C.

(57) ABSTRACT

To close off tubular ends (6*a,* 6*b*) of a metal-halide discharge vessel, a plug (11) having at least four, and preferably six or more, axially arranged layers or strata (11*a*–11*d;* 21*a*–21*f*) of a cermet, in which the metal content of the cermet of the respective layers or strata increases from the layer or stratum closest to the discharge space of the vessel to the outside. The innermost layer or stratum is directly sintered to the ceramic discharge vessel, typically of aluminum oxide, whereas the outermost layer or stratum has a metal content of such an extent that it can be welded, and is welded, to a metallic or cermet lead-through or feed-through (9, 20, 30, 35) leading through a central opening in the respective layers or strata of the plug. The outermost layer of the plug, preferably, has at least 50%, by volume, of metal, preferably of the same material as that of the lead-through in the cermet, and may even be made entirely of metal, to ensure a tight, easily made weld connection. The weld can be made, for example, by laser welding.

17 Claims, 3 Drawing Sheets

METAL HALIDE LAMP WITH ALUMINUM GRADATED STACKED PLUGS

Reference to related patents and applications, the disclosures of which are hereby incorporated by reference:

U.S. Pat. No. 4,155,758, Evans

U.S. Pat. No. 5,484,315, Juengs et al.

U.S. Pat. No. 4,602,956, Partlow et al.

U.S. Pat. No. 5,404,078, Bunk et al.

U.S. Pat. No. 5,424,609, Geven et al.

U.S. Pat. No. 5,637,960, Juengst et al.

U.S. Pat. No. 5,592,049, Heider et al.

U.S. Ser. No. 09/103,365, filed Jun. 23, 1998, Nagayama based on application PCT/JP93/00959, U.S.-designated, published as EP 0 650 184 A1.

Reference to related copending applications, assigned to the assignee of the present application or to a company within the corporate structure thereof, the disclosures of which are hereby incorporated by reference:

U.S. Ser. No. 09/103,365, filed Jun. 23, 1998, Huettinger et al. claiming priority German Appl. 197 27 429.3, filed Jun. 27, 1997;

U.S. Ser. No. 09/102,067, filed Jun. 22, 1998, Juengst and Huettinger claiming priority German Appl. 197 27 430.7, filed Jun. 27, 1997;

U.S. Ser. No. 08/883,939, now U.S. Pat. No. 5,861,714, filed Jun. 27, 1997, Wei, Juengst, Thibodeau, Severian;

U.S. Ser. No. 08/883,852, now U.S. Pat. No. 6,020,685, filed Jun. 27, 1997, Wei and Juengst.

FIELD OF THE INVENTION

The present invention relates to metal-halide discharge lamps having a ceramic discharge vessel, especially lamps intended to operate at a relatively high temperature, in the order of up to about 1000° C., and having a power rating of up to several hundreds of watts, and more particularly to an arrangement to pass an electrical lead-through, in sealed, vacuum-tight relation from the outside into the interior of the discharge vessel, in spite of the high lamp operating temperature.

BACKGROUND

Discharge lamps, and particularly high-power metal-halide discharge lamps, present problems in connection with reliable long-term seal of an electrical lead-through into a ceramic discharge vessel. Ceramic plugs are customarily used. There are many proposals for solutions to the problems. A pin or a tubular element of a metal, such as tungsten or molybdenum, is used as the electrical conductor. The plug may be of ceramic, and the pin or tube is melt-sealed by means of a glass melt or a melt ceramic into the plug. Alternatively, the lead-through may be directly sintered to the plug. The connection between the ceramic and the metal is not a secure bond however, so that the seal has a limited lifetime. It has also been proposed to use a cermet, which is a combination material formed of ceramic and metal, as the material for the plug—see U.S. Pat. Nos. 5,404,078, Bunk et al., and 5,592,049, Heider et al.

Plugs have been tested which comprise a plurality of layers of cermet with different relationships of metal to ceramic to provide for better matching of thermal coefficients of expansion. European EP 0 650 184 A1, Nagayama, to which U.S.-designated PCT/JP93/00959 corresponds, discloses a non-conductive cermet plug having axially arranged layers. This seal is very complex and uses a lead-through which has a thread, an outer metal disk or flange, and a metal or glass melt.

U.S. Pat. No. 4,602,956, Partlow et al., discloses a metal-halide discharge lamp having a ceramic discharge vessel. The electrode is carried in a lead-through which is formed as a disk of electrically conductive cermet. The electrode is sintered into the cermet. Additionally, the lead-through is surrounded by a ring-shaped stopper or plug of cermet which is connected with the ceramic discharge vessel, typically of aluminum oxide, by a glass melt. The glass melt, however, is corroded by aggressive components of the fill in the discharge lamps, particularly by the halides therein, so that the lifetime of such a lamp is rather short. Embedding the electrode in the cermet lead-through, additionally, leads to stresses which eventually may lead to fissures and cracks in the cermet. The diameter of the disk lead-through is quite large. The lead-through is electrically conductive and, thus, the discharge arc can flash back or arc back to the lead-through which would quickly lead to blackening of the discharge vessel.

U.S. Pat. No. 4,155,758, Evans, describes a special arrangement for a metal-halide lamp having a ceramic discharge vessel without an outer surrounding envelope. The lead-through is formed as a pin of electrically conductive cermet. The electrode is sintered into the cermet. The cermet pin in turn is sintered into a plug of aluminum oxide, and this plug is connected to the vessel by a glass melt. This arrangement also has the disadvantages above mentioned.

U.S. Pat. No. 5,424,609, Geven et al., describes a metal-halide discharge lamp with ceramic discharge vessel which requires an extremely long-drawn capillary tube of aluminum oxide as an inner plug element. A pin-like metallic lead-through is connected by a glass melt at the outer end in a melting zone. It is important that the melting zone is at a sufficiently low temperature. The lead-through pin can be made of two parts, in which the part facing the discharge can be made of an electrically conductive cermet, which contains carbide, silicide or a nitride. The sealing technology results in a large overall length of the discharge vessel, it is expensive to make and, also, uses the corrosion-susceptible glass melt. The gap between the capillary tube and the lead-through results in a comparatively large dead volume in which a substantial portion of the fill in the lamp may condense, so that a large quantity of fill is necessary. The aggressive fill has intensive contact with the corrosion-susceptible components in the sealing region. This technology can be used only in small power ratings, up to about 150 W, since, with larger inner diameters of the capillary tube, the actual difference in thermal expansion between the lead-through pin of cermet and the capillary tube would be too great.

SUMMARY OF THE INVENTION

It is an object to provide a metal-halide lamp, having a ceramic discharge vessel, which has a long lifetime and does not use glass melt in a seal between a lead-through and the vessel itself, or a plug therein. The seal must be vacuum-tight, capable of withstanding high temperatures, and not subject to corrosive attack by the fill within the discharge vessel.

Briefly, the lamp has two end portions which are closed by a plug through which a lead-through is connected. The discharge vessel, typically, is made of aluminum oxide. In accordance with a feature of the invention, the plug is formed of at least four axially stacked layers or strata made of a cermet which is constituted of aluminum oxide and a metal, for example tungsten or molybdenum. In accordance with a feature of the invention, the metal content increases from a region close to the discharge arc, that is, the interior of the vessel, towards the outside. In other words, the metal content increases with increasing distance from the discharge arc region of the lamp.

For ease of description, the term "cermet" will be used to describe the plug layers even though the content of ceramic and metal, respectively, of the cermet may be 100% or 0. Thus, the innermost or outermost layer of the plug may be just ceramic, typically aluminum oxide at the inside, or just metal at the outside.

It is an important feature of the invention that the outermost layer of the plug have such a high metal content that it permits welding of this layer with the lead-through, or feed-through, extending into the interior of the discharge vessel. This requires an electrical conductivity of this outermost layer of at least 5 mΩ, and this corresponds to a proportion of metal of at least 50%, by volume. As the number of layers increases, the metal content of the outermost layer can be increased. From six layers on up, the outermost layer can be made of metal, so that, then, differences in expansion due to changes in temperature can be kept very small.

The feed-through is vacuum-tightly connected to the outermost layer by welding. The feed-through is spaced from the other, further inwardly positioned layers or strata by a capillary gap, for example a few $\mu$m wide. The advantage of sealing the discharge vessel by welding is high resistance against corrosion, high temperature acceptance, and high strength of the weld connection.

The feed-through may be a pin, rod or a tube, made of a material which is electrically conductive. The material of the feed-through should be matched as well as possible to the outermost layer of the plug, at least with respect to the thermal coefficient of expansion, and also to the composition of the material. Ideally, the outermost layer of the plug and the feed-through are of essentially identical material. Deviations are possible, however, and for example the outermost layer as well as the feed-through may be of just metal. Alternatively, both the outermost layer and the feed-through may, however, already include a weldable cermet having a metal content of at least 50%, by volume.

The innermost layer of the plug is connected with the end of the discharge vessel which is devoid of a glass melt. Typically, the connection is by direct sintering of the plug into the tubular end of the discharge vessel.

It is a specific advantage of the present invention that no perceptible thermal differences of expansion occur between the material of the lead-through and that of the outer layer of the plug, since the two materials, in accordance with the invention, are similar, and preferably identical. The seal is particularly durable because by welding, a secure and reliable connection is obtained over a long period of time. This is an advantage over the technology of sintering or melting together two connecting partners. Small differences in expansion which occur with metals such as molybdenum and tungsten, and in a cermet which is highly charged with these metals, still do not lead to fissures as soon as before, since stresses can be accepted by the elasticity of the metal. On the other hand, however, the innermost layer of the plug may be selected to have a material which is so close to that of the discharge vessel itself, so that also in that region a reliable long-term bond can be obtained.

The lead-through can be a pin made of high temperature resistant metal, typically tungsten or molybdenum; it may, however, also be a cermet which is constituted by a mixture of aluminum oxide and tungsten, or molybdenum, respectively.

In accordance with a second embodiment of the invention, the feed-through is a tube made of high temperature resistant metal. This form of feed-through is particularly suitable for high-power lamps, for example of 250 to 400 W. Use of a tube as a feed-through has the advantage that larger bores in the plug, which are necessary to permit passage of larger electrodes for high-power lamps, can be sealed without excessive heat loss of the electrode. Use of an electrode system formed of a tubular lead-through and an electrode permits easy assembly of the system together with the plug at the end of the discharge vessel by sintering. The tubular opening can be selected independently of the size of the electrode. In this case, the opening is closed off only after filling of the lamp with a filling pin or rod. Filling pin, tube and cermet can then be welded together in one single step. A separate fill bore in the plug, as previously frequently necessary, will then no longer be required.

The present invention thus provides a metal-halide discharge lamp having a ceramic discharge vessel, typically of aluminum oxide, which usually is surrounded by an outer envelope. The discharge vessel is formed with two tubular end portions, which are closed off by sealing elements so that they can form sealed vessels. Customarily, these sealing elements are one-piece or multi-piece closing plugs. At least at one end of the discharge vessel, a construction, in accordance with the invention, is used in which an electrically conductive lead-through is vacuum-tightly passed through a central bore of the sealing element. An electrode on an electrode shaft is secured to the lead-through, which extends into the interior of the discharge vessel. The lead-through, overall, is a subassembly of a metal or a cermet, with a metal content which is so high that it can be welded just like a metal. The lead-through thus can be connected by welding, that is, completely devoid of glass melt, in a closing plug. The closing plug itself is secured to the vessel again without use of a glass melt, typically by directly sintering together the plug and the end portion of the vessel.

The ceramic portion of the cermet is made of aluminum oxide; the metallic portion is made of tungsten, molybdenum or rhenium. The principal structure of suitable materials for cermet is known per se, see for example the referenced prior art discussed above, or U.S. Pat. No. 5,404,078, Bunk et al., and U.S. Pat. No. 5,592,049, Heider et al., both assigned to the assignee of the present application. The material of the cermet, in accordance with a feature of the invention, must be weldable as well as being electrically conductive.

An example of a suitable cermet is one having 50%, by volume, of molybdenum, the remainder aluminum oxide. Other examples are described in the referenced copending applications all having first filing dates of Jun. 27, 1997, for example U.S. Ser. No. 09/103,365, filed Jun. 23, 1998, Huettinger et al. claiming priority German Appl. 197 27 429.3, filed Jun. 27, 1997, U.S. Ser. No. 09/102,067, filed Jun. 22 ,1998 Juengst and Huettinger claiming priority German Appl. 197 27 430.7, filed Jun. 27, 1997, U.S. Ser. No. 08/883,939, now U.S. Pat. No. 5,861,714, filed Jun. 27, 1997, Wei, Juengst, Thibodeau, Severian U.S. Ser. No. 08/883,852, now U.S. Pat. No. 6,020,685, filed Jun. 27, 1997, Wei and Juengst In accordance with a particularly preferred embodiment of the invention, the lead-through is a pin of an electrically conductive cermet. The shaft of the electrode is butt-welded to an end face of the pin. The pin itself is welded in the plug. The advantage of this arrangement is the small difference of thermal expansion between pin and plug. The cermet, additionally, does not conduct heat as well as metal. A pin of cermet also permits reducing the number of layers of the plug. Rather than using five or six layers for the plug, which are required when the lead-through is metallic, four layers, already, are sufficient.

In accordance with an advantageous feature of the invention, the lead-through is set in the plug with a recess, so that the contact of the lead-through with the fill is minimized, and temperature loading is reduced.

In a form of the invention which is particularly preferred for lower power lamps, the lead-through is an electrically conductive pin or rod of metal. The pin itself can serve as the shaft for the electrode, or can be connected therewith. It can also extend at the outside beyond the plug in order to facilitate connection to an external current supply. Preferably, such a lead-through pin is made of tungsten or molybdenum.

DRAWINGS

Figure 3A:
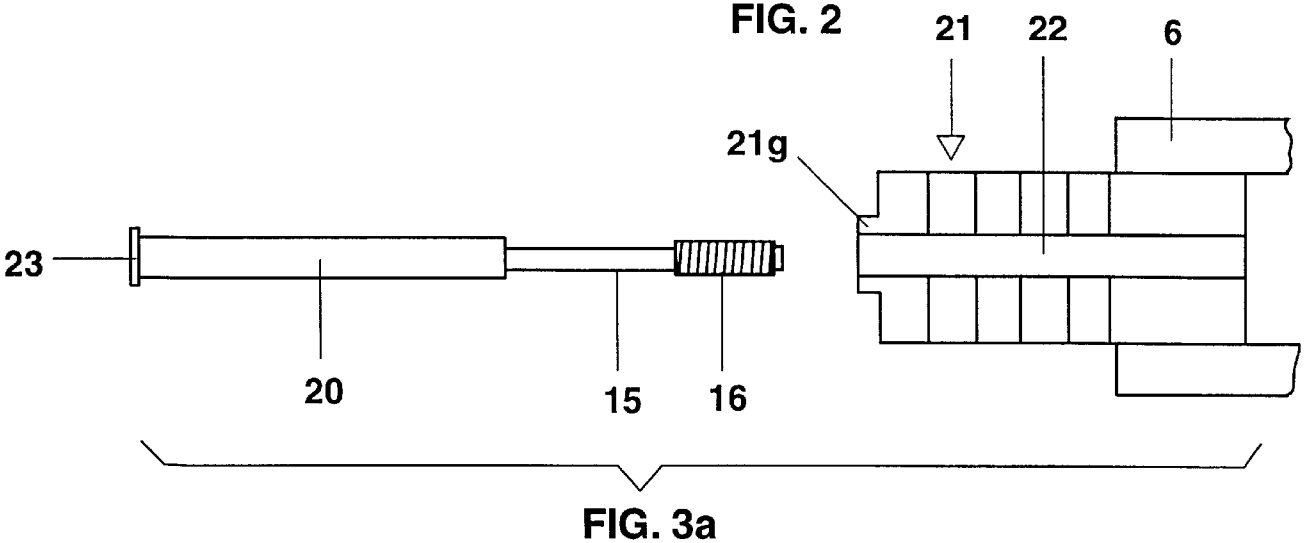
Figure 3B:
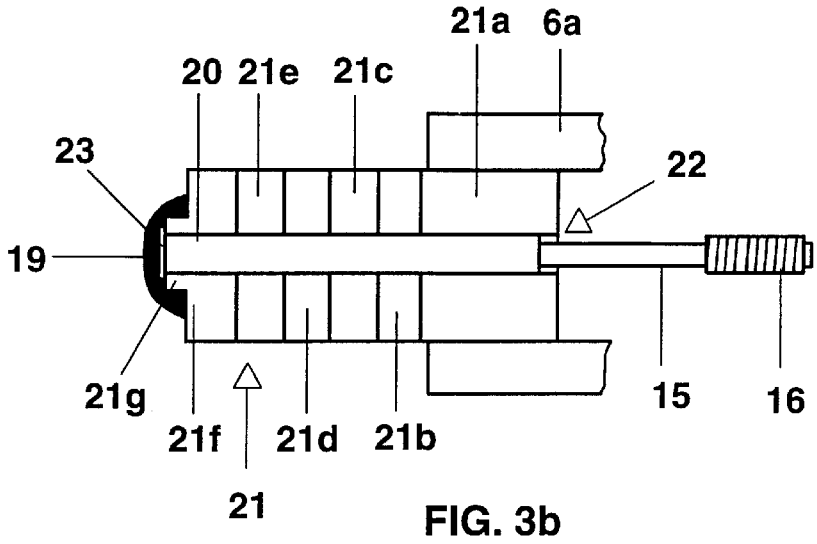

FIG. 3*a* is a schematic side view of another embodiment before assembly into a lamp;

FIG. 3*b* is a view of FIG. 3*a* after assembly and when the seal is complete.

Figure 4:
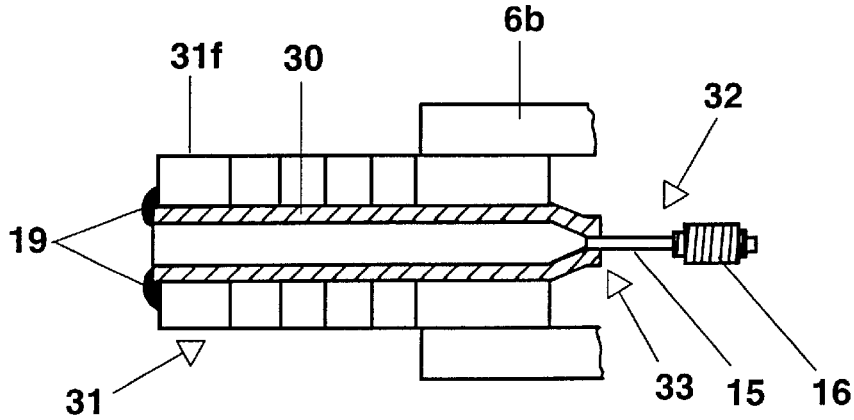
Figure 5:
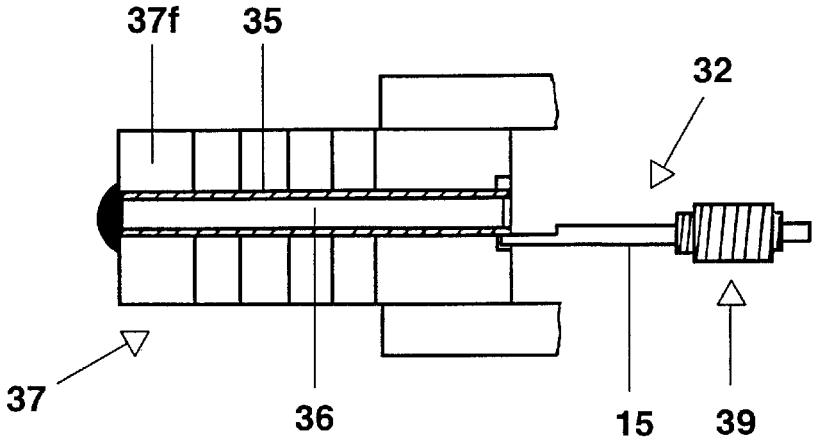

FIG. 4 is a schematic side view of another embodiment of the invention, using a tubular lead-through; and FIG. 5 is another embodiment of the invention, partly in section, also utilizing a tubular lead-through.

DETAILED DESCRIPTION

Figure 1:
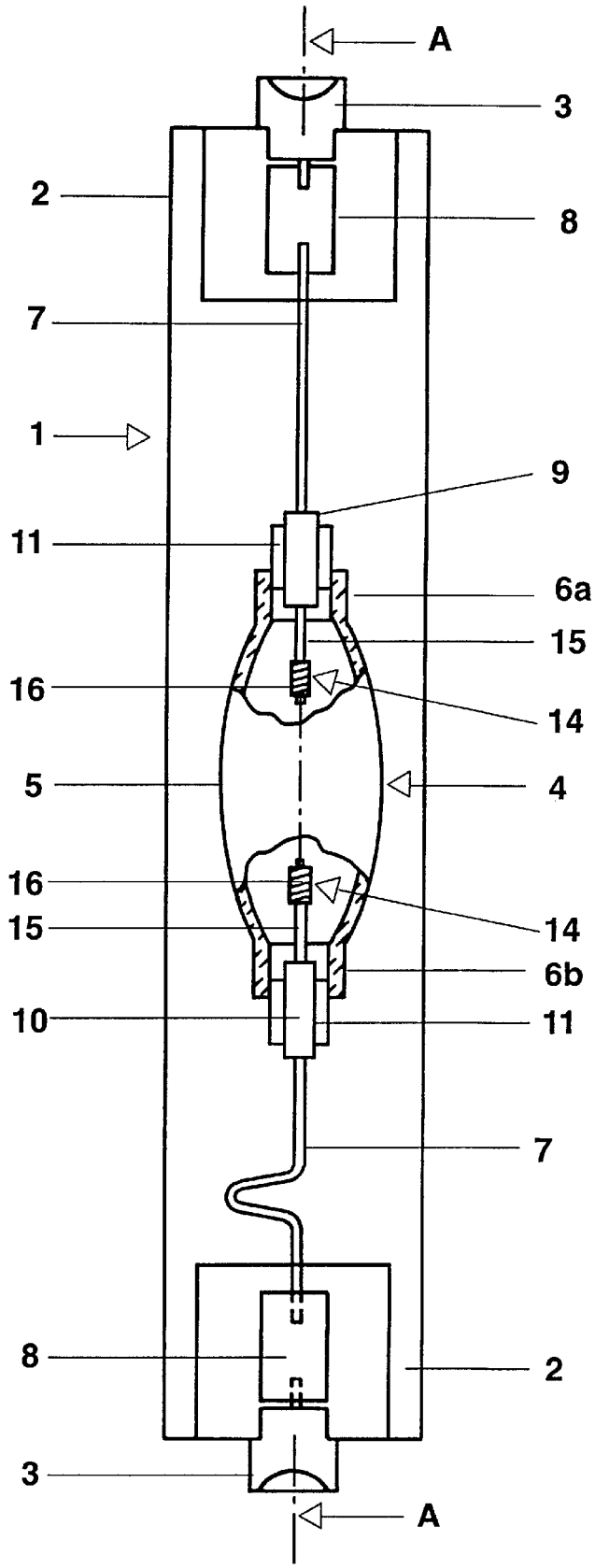
FIG. 1 is a schematic side view of a metal-halide discharge lamp, partly broken away and in section.

FIG. 1, highly schematically, illustrates a metal-halide discharge lamp of a power rating of 150 W. It has a cylindrical outer envelope 1 of quartz glass, which defines a longitudinal lamp axis A. The envelope is pinch-sealed (2) at its two ends to which respective bases 3 are attached. The discharge vessel 4 is axially located in the envelope and is made of $Al_2O_3$ ceramic. It is bulged outwardly in the center region 5 and has two tubular cylindrical ends 6*a*, 6*b*. Two current supply leads 7 are coupled to the base portions 3 through connecting leads via melted-in foils 8, and they retain the discharge vessel 4 within the envelope 1. The current supply leads 7 are welded to lead-throughs or feed-throughs 9, 10 which, each, are fitted in a respective plug 11 in the end portions 6*a*, 6*b* of the discharge vessel 4.

The lead-throughs 9, 10 are pins made of cermet with a diameter of about 1 mm. The cermet is conductive and weldable, and is made of about 50% tungsten, the remainder aluminum oxide. 50% molybdenum, rather than the tungsten, is also suitable.

Both lead-throughs 9, 10 extend outwardly beyond the respective plug 11. At the inside, that is, the discharge space within the vessel 4, the lead-throughs 9, 10 hold electrodes 14. The electrodes 14 are formed of an electrode shaft 15 of tungsten, on which a wrap winding 16 is attached at the inner, that is, discharge side end. The lead-throughs 9, 10 are butt-welded with the respective electrode shafts 15, as well as with the outer current supply leads 7. The diameter of the wrap winding is somewhat less than the diameter of the lead-through so that the entire electrode system can be inserted through a suitable central bore of the respective plug 11.

The discharge vessel retains a fill which has an inert ignition gas, for example argon, and mercury, as well as metal-halide additives. It is also possible to use a metal-halide fill without mercury, and to use xenon under high pressure as the ignition gas.

In accordance with a feature of the invention, the end plugs 11, or at least one of them, essentially are made of axially stacked layers or strata of cermet, having a ceramic component of $Al_2O_3$ and, as a metallic component, tungsten or molybdenum. They are directly sintered into the respective end portions 6*a*, 6*b* of the discharge vessel 4.

Figure 2:
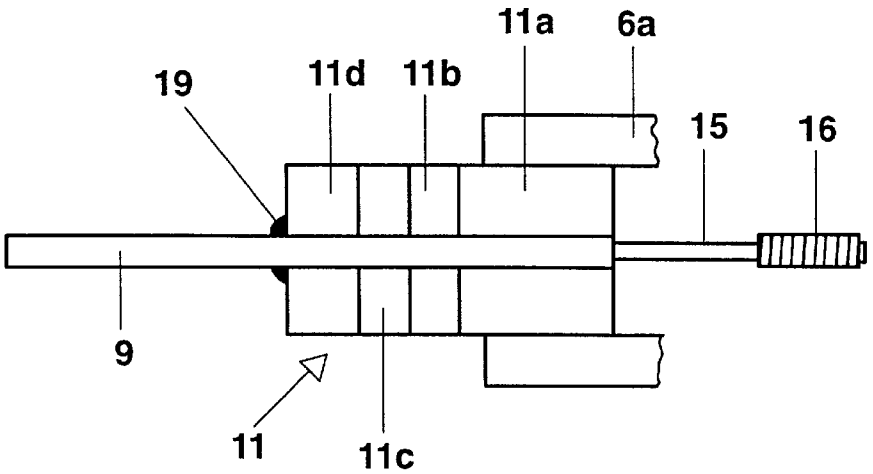
FIG. 2 is a schematic fragmentary view of an end portion of the discharge lamp of FIG. 1 and illustrating one embodiment of a lead-through arrangement.

FIG. 2 illustrates in detail one embodiment of the end portion 6*a* and the plug 11 sintered therein to an enlarged scale. The plug 11 is made of four axially stacked circular rings forming layers or strata. The innermost layer or stratum 11*a* faces the discharge. The innermost layer or stratum 11*a* is made of just aluminum oxide or a cermet having only low metal content. Preferably, the cermet of the innermost ring, at the most, has 8% (by volume) of metal, the remainder aluminum oxide. The ring 11*a* is partially fitted into the end 6*a* of the discharge vessel and directly sinter-connected to the end 6*a*. This connection is devoid of glass melt.

The second ring 11*b*, also of cermet, has however a higher metal content, for example between about 10% to 25% (by volume) of metal. The third ring 11*c* has been about 25% and 40% (by volume) of metal. The fourth ring 11*d*, that is, the outermost ring, has at least 50% (by volume) of metal, and thus is weldable. The lead-through 9 is connected to the outer surface of the outermost ring 11*d* by laser welding, schematically indicated at 19.

In accordance with a preferred feature of the invention, the cermet of the innermost layer 11*a* of plug 11, illustrated in FIG. 2, has 7.5% molybdenum; the second layer 11*b* has 15% molybdenum, the third layer 11*c* has 30% molybdenum, and the outermost layer 11*d* has 50% molybdenum. All percentages by volume.

Referring now to FIGS. 3*a* and 3*b*, illustrating another example of the end portion of the lamp in accordance with the present invention. The lead-through 20 (FIG. 3*a*) is a pin of molybdenum. The plug 21 is formed by six layers or strata of a cermet, each layer forming a circular ring with a central opening. The innermost—with respect to the lamp vessel 4—layer 21*a* has 5% to 8% by volume molybdenum, the remainder aluminum oxide. The axial extent of this layer is larger than that of the other layers. The second ring 21*b* has 10% to 25% by volume Mo, the third ring 21*c* between 25% and 40% by volume Mo, the fourth ring 21*d* 50% to 70% by volume Mo, the fifth ring 21*e* 70% to 90% by volume Mo, and the outer ring 21*f* is made of molybdenum and thus is excellently weldable. The outer ring 21*f* is formed with a collar-like extension 21*g* of about 1 mm axial length and having a wall thickness of about 0.5 mm. The lead-through 20 extends slightly above this collar 21*g* and has at its outer end a lateral thickening 23 (FIG. 3*a*). This thickening 23*a* can be formed from a cutting burr or a welding point, and fixes the position of the lead-through 20 in the plug 21. The outer ring 21*f*, including the collar 21*g*, is secured to the lead-through 20 by a weld 19, in the form of a ball melt.

In accordance with a preferred feature of the invention, and specifically for the lamp of FIG. 1, the plug 21 has the following layers: first layer 21*a*: 5% molybdenum; second layer 21*b*: 15% Mo; third layer 21*c*: 30% Mo; fourth layer

21*d:* 55% Mo; fifth layer 21*e*: about 80% Mo. The outermost layer 21*f*, including collar 21*g,* is molybdenum, or a weldable cermet with high molybdenum content. All percentages by volume. In this example, the relative differences in thermal coefficients of expansion are particularly low.

To assemble this lamp, the pin 20 is pushed through the central bore 22 (FIG. 3*a*) of the plug until the end thickening 23 abuts against the extension 21*g*. A weld 19 is then formed, the reference numeral 19 schematically indicating the weld bead, to weld together the last layer or stratum 21*f,* which may be just molybdenum or a high metal weldable cermet layer, including the collar 21*g*. The outer current supply 7 (FIG. 1) can be easily welded directly to the collar 21*g* of the plug, since this collar is also highly conductive.

FIG. 3*a* illustrates that the bore itself can be used initially for evacuating and placing the fill. Only after the vessel has been evacuated and filled, is the pin itself introduced and welded at the outside (FIG. 3). This welding technology, in contrast to sinter technology, can be carried out simply and rapidly and does not require high temperatures outside of the welding region.

FIG. 4 illustrates another embodiment in which each(or at least one)of the two ends 6*a,* 6*b* of the discharge vessel is secured to a lead-through in form of a molybdenum tube 30, which is welded to a six-layer cermet plug 31 at the outer end by a weld 19.

The molybdenum tube 30 retains the electrode 32 in a crimp 33, in which the electrode is also gas-tightly welded. Here again, the bore in the plug can be used initially for filling. Only afterwards, the electrode system of electrode 32 and tube 30 is inserted through the stack of layers, and the ring gap is welded closed at the outer end.

A tubular lead-through 35 of molybdenum can be used, in accordance with another example of the present invention, also with high-power lamps, for example a lamp of 250 W rating. It is formed as a continuous cylinder, see FIG. 5. At the discharge side end, the electrode 32 is eccentrically secured to the tube 35. The head 39 of the electrode 32 has a two-layer wrapping, and thus forms a wide head. The outermost layer 37*f* of the plug 37 can be provisionally and preliminarily attached to Mo tube 35 by sintering.

After evacuating and filling, the tube 35 is closed by a metal pin 36 which is welded to the tube 35. The tube 35, simultaneously, is welded to the outer layer 37*f* of the plug 37. In other words, the final long-term reliable sealing of the bore of the plug is by welding—a technology far superior to direct sintering between a metal and cermet. Use of a tube as the lead-through has the advantage that it is easy to attach the electrode thereto. This also has the additional advantage that a relatively wide electrode can be introduced into the discharge vessel although the bore in the plug is much smaller. Initially, the plug 37, together with the preliminarily or loosely inserted electrode system, is introduced into the respective end 6*a* or 6*b* of the discharge vessel and directly sintered thereinto. Simultaneously, a preliminary provisional sintering of the outer end of the plug, that is, the last layer 37*f,* to the tube 35 can be carried out. Alternatively, the end of the lead-through can be formed with a transverse abutment in order to provide preliminary provisional attachment.

The size of the electrode, thus, is not limited by the diameter of the bore or central opening through the plug. The tubular lead-through 35, before introduction of the metallic pin 36, will form a fill opening.

This embodiment is particularly suitable when the fill opening can be selected to be independent of the size of the electrode—which, in turn, depends on the power rating of the lamp.

Tubular technology is also particularly suitable for higher power ratings in which the electrode has a large diameter and substantial transverse dimensions. The dimension of the tube itself is not critical, because the difference in thermal expansion relationships between the lead-through and the outermost layer at the end of the plug can be maintained to be a minimum. The outermost layer of the plug uses a material which is similar to that of the tube or, preferably, is the same.

Closing the ring gap between the tube 35 and the plug 37, or between the tube 35 and a filling pin 36, is easy, even if the diameters are relatively large.

Lamps with high power rating preferably use tubular lead-throughs, since pins must be matched to the required larger diameter of the electrode, and then would remove too much heat. This may lead to difficulties during ignition of the lamp. The tubular technology for the first time permits manufacture of metal-halide lamps with ceramic discharge vessels also at higher power ratings, that is, 150 W or more, and provides reliable seals. The size of the electrode, particularly its outer diameter, increases with the power rating. In accordance with the present invention, the diameter of the lead-through itself need not be increased correspondingly.

In a particularly preferred embodiment of the invention, the lead-through is made of just molybdenum, either in pin form or tubular form, and the plug is made of a cermet with six layers. The metal part of the cermet is tungsten. Tungsten, since it has a higher coefficient of thermal expansion in comparison to molybdenum, is preferred because then the coefficient of expansion of the individual layers is more easily controlled. The innermost layer has 2%, by volume, tungsten, corresponding to approximately 10%, by weight, of tungsten, the remainder aluminum oxide. Thermal expansion of the end of the discharge vessel, thus, can be easily matched since it is made of just aluminum oxide. The second layer has about 15% by volume tungsten, which corresponds to about 46% by weight. The third layer has about 28% by volume tungsten, which corresponds to about 67% by weight. The fourth layer has about 42% by volume tungsten, which corresponds to about 78% by weight. The fifth layer has about 56% by volume tungsten, which corresponds to about 88% by weight. The outermost, sixth layer has about 69% by volume tungsten, which corresponds to about 90% by weight. The thermal coefficient of expansion of the last layer, thus, is ideally matched to the lead-through 35 of molybdenum.

The above values are so selected that the difference in thermal coefficients of expansion for all layers of the plug differ, respectively, with respect to each other by about equal amounts. The thermal loading thus is essentially uniformly distributed throughout the length of the plug. A temperature of 1000° C. is used as a reference level.

The axial lengths of the respective layers or strata of the plug 11 are not critical. Typically, the innermost layer or stratum 11*a,* 21*a* is axially longer than the remaining layers or strata which may all be of the same axial lengths; or, for example, the outermost layer or stratum 31*f* (FIG. 4) of the plug can also be axially somewhat longer than the intermediate layers or strata between the outermost and innermost ones.

Various changes and modifications may be made, and any features described in connection with any one of the embodiments may be used with any of the others, within the scope of the inventive concept.

I claim:

1. A metal-halide discharge lamp comprising:

a ceramic discharge vessel (4), said discharge vessel having two tubular end portions (6*a*, 6*b*);

a plug (11) closing each of said tubular end portions;

an electrically conductive and weldable lead-through or feed-through (9, 10; 20, 30, 35) which passes through each said plug in a vacuum-tight manner (11);

an electrode (14) secured to each lead-through and being located in the interior of the discharge vessel (4);

wherein at least one said plug is formed of axially stacked layers or strata (11*a*–11*d*; 21*a*–21*f*), each of said layers or strata comprising a cermet having a metal content, in which the metal content of the cermet in the layers or strata increases in a direction outwardly from a layer or stratum disposed interiorly with respect of the end portions of the discharge lamp, and wherein at least one said plug (11) in at least one end portion (6*a*) comprises:

at least four axially placed layers or strata, an outermost layer or stratum (11*d*, 21*f*, 31*f*) comprising at least 50%, by volume, of a metal, the remainder being a ceramic, said metal being weldable;

a weld (19) connecting said lead-through (9) to said outermost layer or stratum (11*d*) in a vacuum-tight manner; and wherein an innermost layer or stratum (11*a*, 21*a*) of the plug (11) is connected in a vacuum-tight manner by a direct sinter connection to a respective end portion (6*a*, 6*b*) of the discharge vessel which is devoid of a glass melt material or a ceramic melt material.

2. The lamp of claim 1, wherein the lead-through (9, 10) comprises a pin of a high temperature resistant metal, or an electrically conductive cermet; and wherein the material of the pin at least approximately, or substantially, is the same as the material of the outermost layer or stratum (11*d*, 21*f*) of the plug.

3. The lamp of claim 1, wherein the plug comprises up to six layers or strata (21*a*–21*f*), and wherein the metal content of said layers or strata increases outwardly of the discharge vessel.

4. The lamp of claim 1, wherein the outermost layer or stratum (11*d*, 21*f*, 37*f*) of the plug is essentially metal.

5. The lamp of claim 1, wherein the innermost layer or stratum (11*a*, 21*a*) of the plug is essentially aluminum oxide.

6. The lamp of claim 1, wherein said lead-through comprises a tubular element (30, 35) of a high temperature resistant metal.

7. The lamp of claim 6, wherein the lamp has a power rating of at least 150 W.

8. The lamp of claim 6, wherein the electrode has an electrode head (39) which is wider than the outer diameter of the tubular element.

9. The lamp of claim 6, further including a filling pin (36) inserted in the tubular lead-through (35).

10. The lamp of claim 1, wherein the discharge vessel is made of aluminum oxide.

11. The lamp of claim 1, wherein the axial length of the innermost layer or stratum (11*a*, 21*a*) is longer than that of other layers or strata forming the plug (11).

12. The lamp of claim 1, wherein the axial length of said strata or layers, except for the first layer or stratum (11*a*, 21*a*) is essentially uniform.

13. The lamp of claim 1, wherein the axial length of said layers or strata (11*a*–11*d*; 21*a*–21*f*) is non-uniform.

14. The lamp of claim 1, wherein the axial lengths of the innermost and outermost layers or strata (11*a*, 11*d*; 21*a*, 21*f*) are longer than axial the lengths of the remaining layers or strata (11*b*, 11*c*; 21*b*–21*e*).

15. The lamp of claim 1, wherein an outermost layer or stratum (21*f*) of said layers or strata of the plug (11) is formed with a positioning collar (21*g*); and the lead-through (20) is formed with an end stop (23) engaged by said positioning collar for precisely positioning the lead-through, and hence an electrode head (16) thereon, within the discharge vessel.

16. The lamp of claim 2, wherein the plug is a cermet plug.

17. The lamp of claim 2, wherein the high temperature resistant metal is selected from the group consisting of tungsten and molybdenum.

* * * * *